US010330445B1

(12) United States Patent
Baum et al.

(10) Patent No.: US 10,330,445 B1
(45) Date of Patent: Jun. 25, 2019

(54) TUNABLE CYLINDRICAL SHAPED CHARGE

(71) Applicant: LAWRENCE LIVERMORE NATIONAL SECURITY, LLC, Livermore, CA (US)

(72) Inventors: Dennis Willard Baum, Danville, CA (US); Vladimir Georgevich, San Ramon, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 15/882,099

(22) Filed: Jan. 29, 2018

(51) Int. Cl.
*F42B 1/028* (2006.01)
*F42B 1/032* (2006.01)
*F42B 1/036* (2006.01)

(52) U.S. Cl.
CPC ..... *F42B 1/028* (2013.01); *F42B 1/032* (2013.01); *F42B 1/036* (2013.01)

(58) Field of Classification Search
CPC ..... F42B 1/028; F42B 1/032; F42B 1/036
See application file for complete search history.

(56) References Cited

U.S. PATENT DOCUMENTS 2,988,994 A * 6/1961 Fleischer, Jr. ..... F42B 12/10 102/306
3,732,818 A * 5/1973 Thomanek ..... F42B 1/024 102/306
4,187,782 A * 2/1980 Grace ..... F42B 1/02 102/475
4,513,666 A * 4/1985 Segletes ..... F42B 1/036 102/307
5,271,332 A * 12/1993 Guirguis ..... F42B 1/02 102/283
8,459,186 B2 * 6/2013 Wang ..... E21B 43/117 102/306
9,995,562 B2 * 6/2018 Jennett ..... F42B 1/028
10,036,616 B2 * 7/2018 Gash ..... F42B 1/02

* cited by examiner

*Primary Examiner* — Joshua T Semick
(74) *Attorney, Agent, or Firm* — Eddie E. Scott

(57) ABSTRACT

A shaped charge produces an explosive jet utilizing a cylindrical liner surrounded by tracks of explosives. The tracks of explosives are located on the curved surface of the cylindrical liner in a spiral. The tracks of explosives are wrapped around the cylindrical liner in a spiral at an angle to the charge axis. The angle is determined as an angle that assures that the flow speed of the collapsing cylindrical liner is subsonic compared to the sound speed in the material of the collapsing cylindrical liner. The angle also can be selected and varied to directly control the speed of a non-stretching jet, as well as a velocity gradient to produce a stretching jet.

8 Claims, 13 Drawing Sheets

TUNABLE CYLINDRICAL SHAPED CHARGE

STATEMENT AS TO RIGHTS TO APPLICATIONS MADE UNDER FEDERALLY SPONSORED RESEARCH AND DEVELOPMENT

The United States Government has rights in this application pursuant to Contract No. DE-AC52-07NA27344 between the United States Department of Energy and Lawrence Livermore National Security, LLC for the operation of Lawrence Livermore National Laboratory.

RELATED APPLICATION

Related disclosure is included in U.S. patent application Ser. No. 15/695,486 entitled "Modular Gradient-Free Shaped Charge" filed Aug. 24, 2017. The disclosure of U.S. patent application Ser. No. 15/695,486 filed Aug. 24, 2017 and entitled "Modular Gradient-Free Shaped Charge" is hereby incorporated herein in its entirety for all purposes by this reference.

BACKGROUND

Field of Endeavor

The present application relates to shaped charges and more particularly to a tunable cylindrical shaped charge.

State of Technology

This section provides background information related to the present disclosure which is not necessarily prior art.

Common axisymmetric shaped charge designs utilize a conical liner shape or a variant thereof, surrounded by a layer of high explosive. The explosive progressively collapses the liner onto the axis of symmetry and a jet is formed. The speed profile of the jet is determined by the shape of the liner. In order for the liner collapse to produce a coherent jet, the flow speed of the collapsing liner must be subsonic compared to the sound speed in the collapsing liner. However, the detonation speed of most explosives is greater than the sound speed in common metals and does not satisfy the subsonic requirement.

SUMMARY

Features and advantages of the disclosed apparatus, systems, and methods will become apparent from the following description. Applicant is providing this description, which includes drawings and examples of specific embodiments, to give a broad representation of the apparatus, systems, and methods. Various changes and modifications within the spirit and scope of the application will become apparent to those skilled in the art from this description and by practice of the apparatus, systems, and methods. The scope of the apparatus, systems, and methods is not intended to be limited to the particular forms disclosed and the application covers all modifications, equivalents, and alternatives falling within the spirit and scope of the apparatus, systems, and methods as defined by the claims.

The inventors' shaped charge apparatus, systems, and methods utilize a cylindrical liner surrounded by tracks of explosives to produce an explosive jet. The tracks of explosives are located on the curved surface of the cylindrical liner in a spiral. The tracks of explosives are wrapped around the cylindrical liner in a spiral at an angle to the charge axis. The angle is determined as an angle that assures that the flow speed of the collapsing cylindrical liner is subsonic compared to the sound speed in the material of the collapsing cylindrical liner. In one embodiment the angle is an angle in the range of 47° to 55°. In another embodiment the angle is an angle of 51°.

Detonation of the explosives produces a collapsing cylindrical liner having collapsing liner flow speed. The collapsing cylindrical liner has a sound speed. The angle is chosen to be an angle that assures that the flow speed of the collapsing liner is subsonic compared to the sound speed in the material of the collapsing liner. Placing the tracks of explosives on the curved surface of the cylindrical liner in a spiral provides a longer length of each track of explosives than if they were placed parallel to the central axis of the cylindrical liner. The longer length assures that the flow speed of the collapsing liner is subsonic compared to the sound speed in the material of the collapsing liner.

The inventors' shaped charge apparatus, systems, and methods have us in munitions for military and commercial use. In one embodiment the inventors' shaped charge apparatus, systems, and methods have use for armor penetration. In another embodiment the inventors' shaped charge apparatus, systems, and methods have use is a torpedo. In one embodiment the inventors' shaped charge apparatus, systems, and methods have use as a perforator charge for perforating wells. In another embodiment the inventors' shaped charge apparatus, systems, and methods have use for disposal of bombs and/or ordinances. The inventors' shaped charge apparatus, systems, and methods have other uses whenever and explosive jet is needed.

The apparatus, systems, and methods are susceptible to modifications and alternative forms. Specific embodiments are shown by way of example. It is to be understood that the apparatus, systems, and methods are not limited to the particular forms disclosed. The apparatus, systems, and methods cover all modifications, equivalents, and alternatives falling within the spirit and scope of the application as defined by the claims.

BRIEF DESCRIPTION OF THE DRAWINGS

The accompanying drawings, which are incorporated into and constitute a part of the specification, illustrate specific embodiments of the apparatus, systems, and methods and, together with the general description given above, and the detailed description of the specific embodiments, serve to explain the principles of the apparatus, systems, and methods.

DETAILED DESCRIPTION OF SPECIFIC EMBODIMENTS

Figure 1:
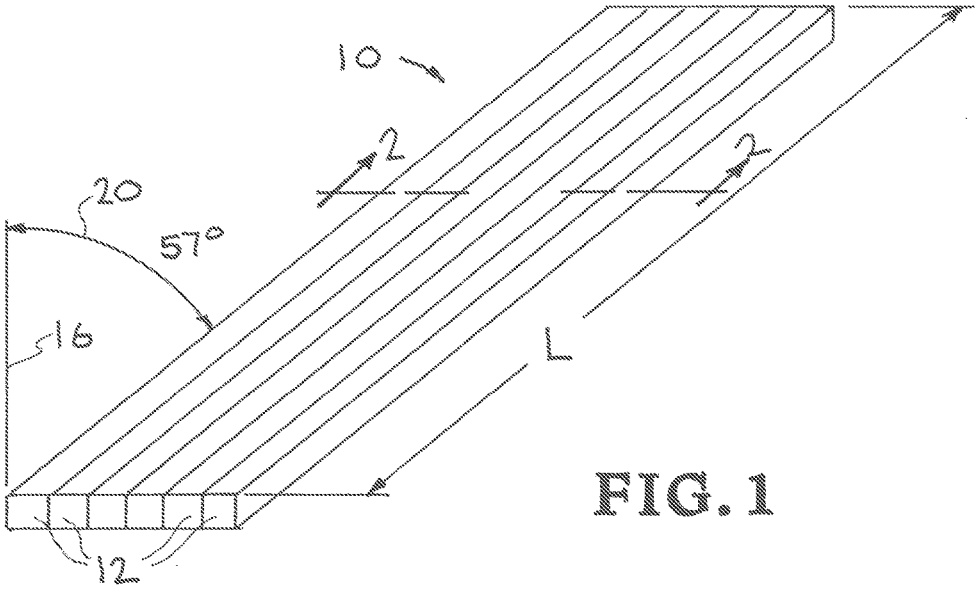
FIG. 1 shows a portion of the tracks of explosives that make up the surrounding layer of explosive.

Referring to the drawings, to the following detailed description, and to incorporated materials, detailed information about the inventors' apparatus, systems, and methods is provided including the description of specific embodiments. The detailed description serves to explain the principles of the apparatus, systems, and methods. The apparatus, systems, and methods are susceptible to modifications and alternative forms. The application is not limited to the particular forms disclosed. The application covers all modifications, equivalents, and alternatives falling within the spirit and scope of the apparatus, systems, and methods as defined by the claims.

The inventors' apparatus, systems, and methods utilize a cylindrical liner and a surrounding layer of explosive in which the detonation front is constrained to propagate at an angle with respect to the charge axis. The prior art axisymmetric shaped charge designs utilize a conical liner shape or a variant thereof, surrounded by a layer of high explosive. The explosive progressively collapses the liner onto the axis of symmetry and a jet is formed. The speed profile of the jet is determined by the shape of the liner. In order for the liner collapse to produce a coherent jet, the flow speed of the collapsing liner must be subsonic compared to the sound speed in the collapsing liner. However, the detonation speed of most explosives is greater than the sound speed in common metals and does not satisfy the subsonic requirement.

The purpose of the "expanding" liner shapes, whether a cone, hemisphere, or complex configuration is to effectively reduce the forward propagation speed of the collapse point, such that it is subsonic. This is accomplished by increasing the radial collapse distance of the liner as the explosive detonation propagates from the base of the liner to the front face of the charge. With the use of precision machined liners and precision explosives, high performance jets can be achieved.

A limitation inherent to all current designs is that length, speed, and diameter of the jet are intimately related, determined by the contour of the liner and one jet parameter cannot be changed independent of the others. The result is that jet length, diameter, and speed cannot be changed independently. Thus, a 2× increase in jet length also results in a 2× increase in diameter and a 2×2×2=8 times increase in charge weight.

Common axisymmetric shaped charge designs utilize a conical liner shape or a variant thereof, surrounded by a layer of high explosive. The explosive progressively collapses the liner onto the axis of symmetry and the liner material jets in the forward direction. In order for the liner collapse to produce a coherent jet, the flow speed of the collapsing liner must be subsonic compared to the sound speed in the collapsing liner. However, the detonation speed of most explosives is greater than the sound speed in common metals. The purpose of the traditional expanding liner shapes, whether a cone, hemisphere, or complex configuration is to effectively reduce the forward propagation speed of the collapse point such that It is subsonic. This is accomplished by increasing the radial collapse distance of the liner as the explosive detonation propagates from the base of the liner to the front face.

The inventors' apparatus, systems, and methods include a cylindrical liner, commonly a metal such as copper or molybdenum, but almost any solid material can be used and a surrounding layer of explosive in which the detonation front is constrained to propagate at an angle with respect to the charge axis. One key to the concept is the ability to deposit a surrounding explosive layer in which the direction of detonation propagation can be controlled. The use of additive manufacturing is proposed with the following two different approaches. 1) wherein individual "logs" of explosive are deposited side by side, with a very thin barrier separating the logs and preventing prompt transmission of the detonation between logs. The barrier must also be very thin to minimize the imprinting of the inert layer interrupting the uniform pressure loading on the liner, as required for a uniform collapse process. 2) the array of very thin barriers can be deposited in barber pole fashion around the cylindrical liner and the explosive can be added through a second process of extrusion, additive manufacturing or other process. There are no limitations on the detonation velocity of the explosive used in this application.

A feature of this design concept is that the jet speed is determined purely by the phase angle of the detonation system. For example, if the phase angle is constant a constant velocity Jet will be produced traveling at approximately twice the axial propagation velocity. For a 51-degree phase angle as illustrated in the application figures, and an axial speed of 5 mm/s, should produce a constant velocity, non-stretching Jet traveling at 10 mm/s. However, the phase angel can be varied as a function of distance from the base of the charge, such that the phase angle increases with travel, which will produce a velocity gradient in the jet from tip to tail, resulting in a stretching jet. This simple control over jet speed (purely a function of the local phase angle of the detonation propagation) is a unique feature of this explosive phasing invention and allows formation of jets with a designed in velocity profile. A second resulting feature of this explosive system is that the longer path length of the explosive propagation compared with the axial progression rate, means that detonating explosive can impart more impulse to the imploding liner because of the increased time for the detonation to traverse a given axial length of liner.

A feature of the cylindrical liner concept is that the length of the liner, the diameter and thickness of the liner can all be varied independently. This feature provides unprecedented design flexibility in independently controlling jet diameter and length. The explosive system adds additional direct control of jet velocity profile, simply through adjustment of the phase angle of the tracks. This combination of independent design features is not possible with current shaped charge designs.

Figure 2:
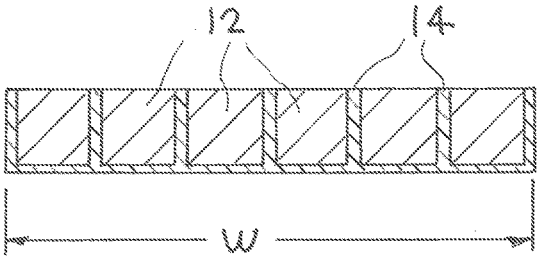
FIG. 2 shows the tracks of explosives in scaffolds.
Figure 3:
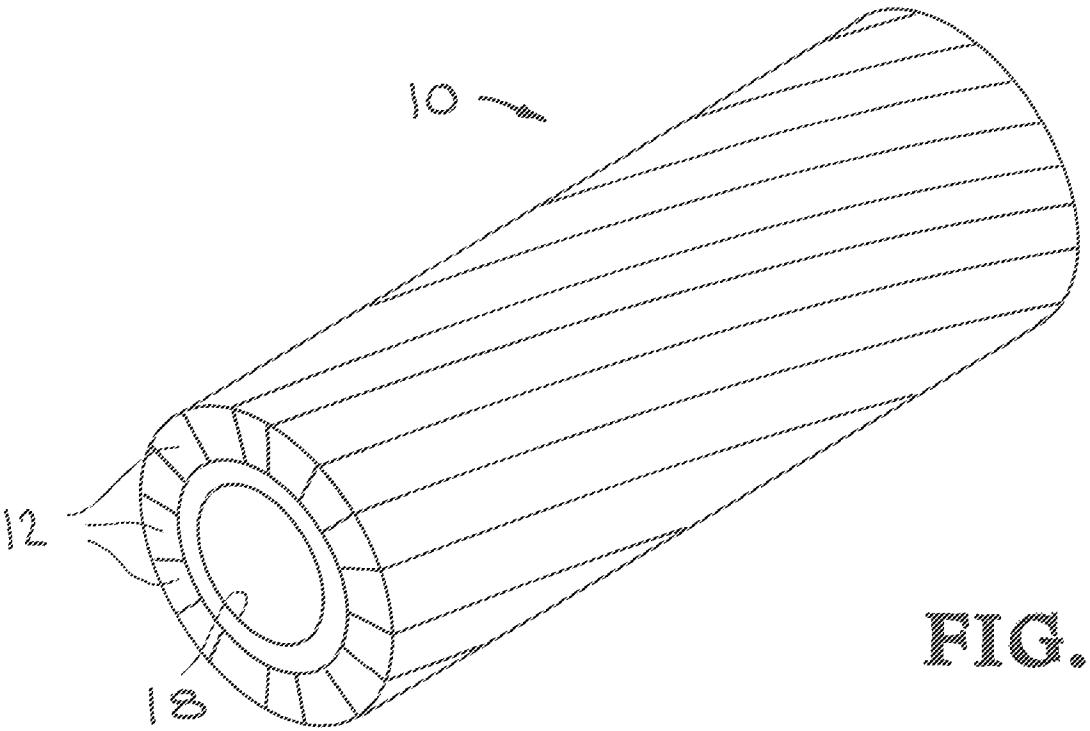
FIG. 3 shows the cylindrical liner with the tracks of explosives on the curved surface of the cylindrical liner in a spiral or at least a portion of a spiral.

Referring now to the drawings; and in particular to FIGS. 1, 2, 3, and 4; an embodiment of the inventors' shaped charge apparatus, systems, and methods that produces a jet is illustrated. This shaped charge embodiment is designated generally by the reference numeral 10. The shaped charge embodiment 10 utilize a cylindrical liner 18 surrounded by tracks 12 of explosives. The detonation front of the tracks 12 of explosives is constrained to propagate at an angle 20 with respect to the charge axis 16. As illustrated in FIG. 3 the shaped charge embodiment 10 includes a cylindrical liner 18. The cylindrical liner 18 is made of a metal such as copper or molybdenum; however, the cylindrical liner 18 can be made of almost any solid material wherein the surrounding tracks 12 of explosives produces a detonation front that is constrained to propagate at an angle 20 with respect to the charge axis 16.

Referring specifically to FIG. 1, a portion of the tracks 12 of explosives that make up the surrounding layer of explosive is illustrated. The tracks 12 of explosives are shown lying flat before they are place on the curved surface of the cylindrical liner 18. The tracks 12 of explosives will be placed on the curved surface of the cylindrical liner 18 in a spiral wherein the angle 20 with respect to the charge axis 16 is an angle in the range of 47° to 55°.

Referring now to FIG. 2, the tracks 12 of explosives are shown in scaffolds 14. The scaffolds 14 provide the thinnest barrier between the tracks 12 of explosives to prevent crosstalk and below the tracks 12 of explosives to minimize imprinting of the material below the bottom of the tracks 12. The scaffolds 14 can be made of a polymer or other material that will prevent crosstalk and below the tracks 12 of explosives and minimize imprinting of the material below the bottom of the tracks 12.

Referring now to FIG. 3, the cylindrical liner 18 is shown with the tracks 12 of explosives on the curved surface of the cylindrical liner 18 in a spiral. The angle 20 of the tracks 12 of explosives with respect to the charge axis 16 (and the angel of the spiral) is selected based on the desired jet velocity. For example, with a detonation speed of 8 mm/μs and a desired axial subsonic propagation speed of 5 mm/μs, the desired angle 20 is 51°, as shown in FIG. 3. The tracks 12 of explosives produce a detonation front that is constrained to propagate at an angle 20 with respect to the charge axis 16.

Figure 4:
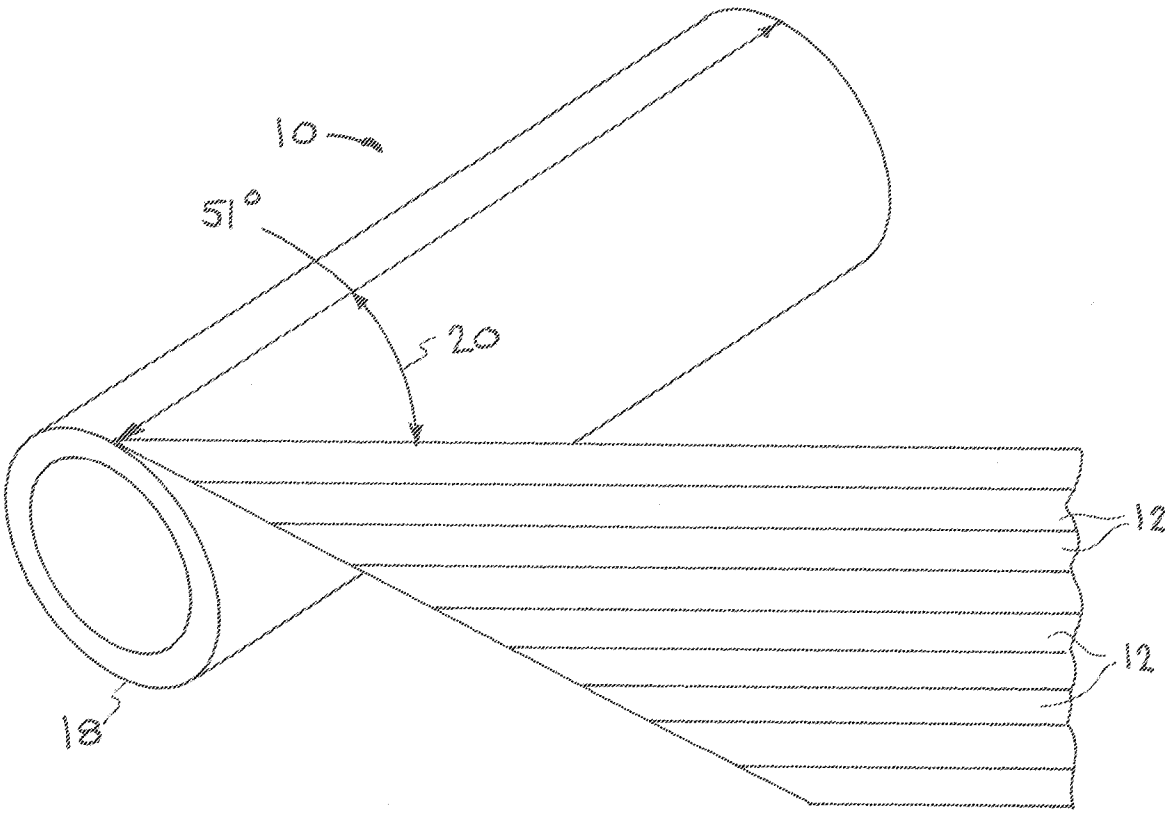
FIG. 4 is an illustration showing the tracks of explosives positioned on the curved surface of the cylindrical liner at an angle forming a spiral or at least a portion of a spiral.

Referring now to FIG. 4, an illustration shows the tracks of explosives 12 positioned on the curved surface of the cylindrical liner 18 at an angle 20 forming a spiral or at least a portion of a spiral. The angle 20 of the spiral is such that the track 12 of explosives produces a detonation front that is constrained to propagate with respect to the charge axis 16.

One key to the concept of the inventors' shaped charge apparatus, systems, and methods is the ability to deposit a surrounding explosive layer in which the direction of detonation propagation can be controlled. The use of additive manufacturing is proposed with potentially two different approaches. 1) wherein individual "logs" of explosive are deposited side by side, with a very thin barrier separating the logs and preventing prompt transmission of the detonation between logs. The barrier must also be very thin to minimize the imprinting of the inert layer interrupting the uniform pressure loading on the liner, as required for a uniform collapse process. 2) the array of very thin barriers can be deposited in barber pole fashion around the cylindrical liner and the explosive can be added through a second process of extrusion, additive manufacturing or other process. There are no limitations on the detonation velocity of the explosive used in this application.

A feature of this design concept is that the jet speed is determined purely by the phase angle of the detonation system. For example, if the phase angle is constant a constant velocity Jet will be produced traveling at approximately twice the axial propagation velocity. For a 51-degree phase angle as illustrated in the application figures, and an axial speed of 5 mm/s, should produce a constant velocity, non-stretching Jet traveling at 10 mm/s. However, the phase angel can be varied as a function of distance from the base of the charge, such that the phase angle increases with travel, which will produce a velocity gradient in the jet from tip to tail, resulting in a stretching jet. This simple control over jet speed (purely a function of the local phase angle of the detonation propagation) is a unique feature of this invention and allows formation of jets with a designed in velocity profile.

Figure 5:
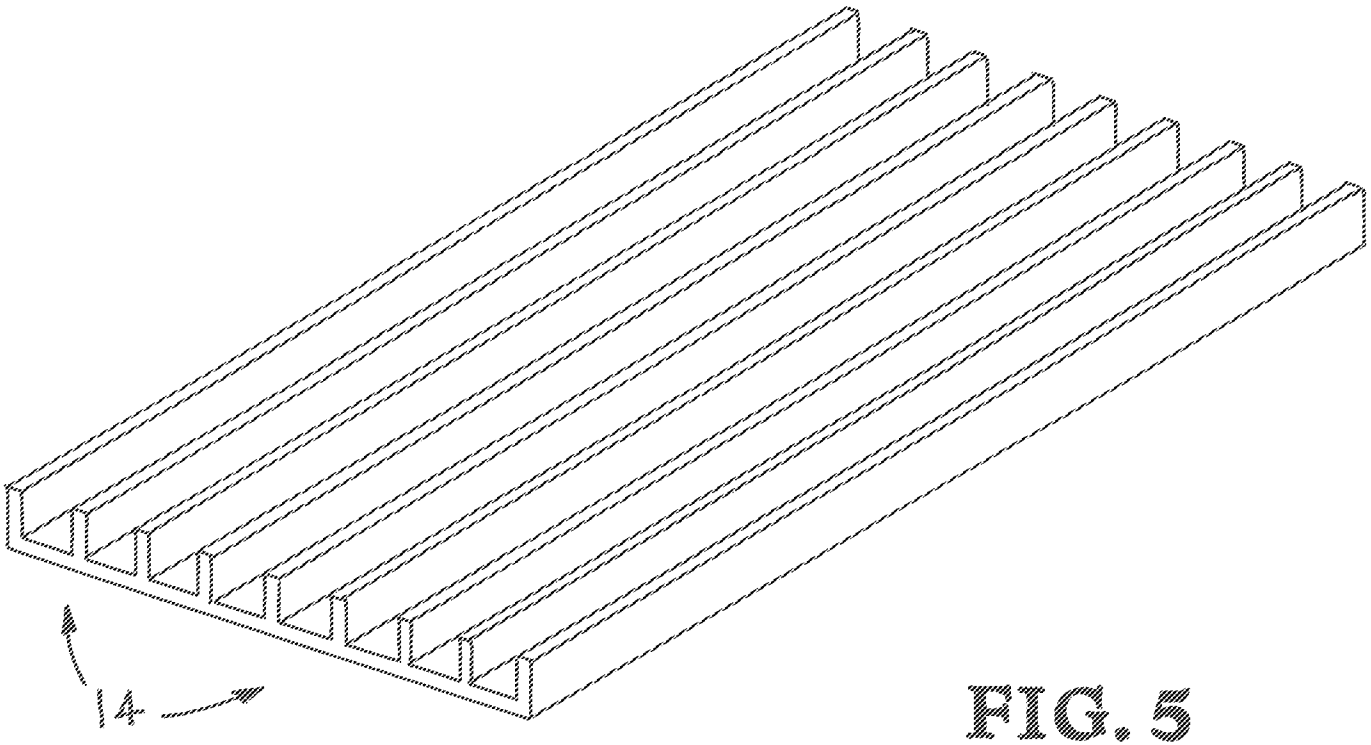
FIG. 5 shows some of the scaffolds that receive a deposit of explosives form the tracks of explosives.
Figure 6:
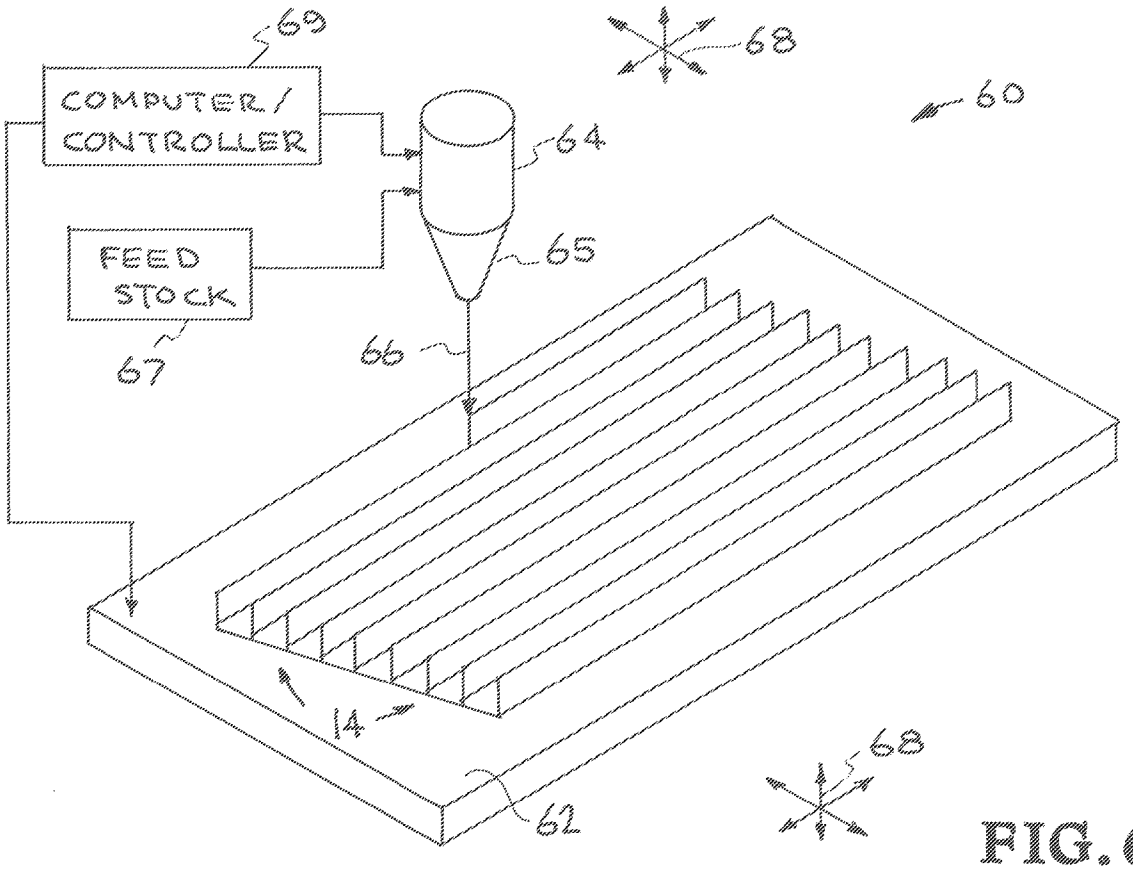
FIG. 6 shows one embodiment of a manufacturing system used to produce the scaffolds.
Figure 7:
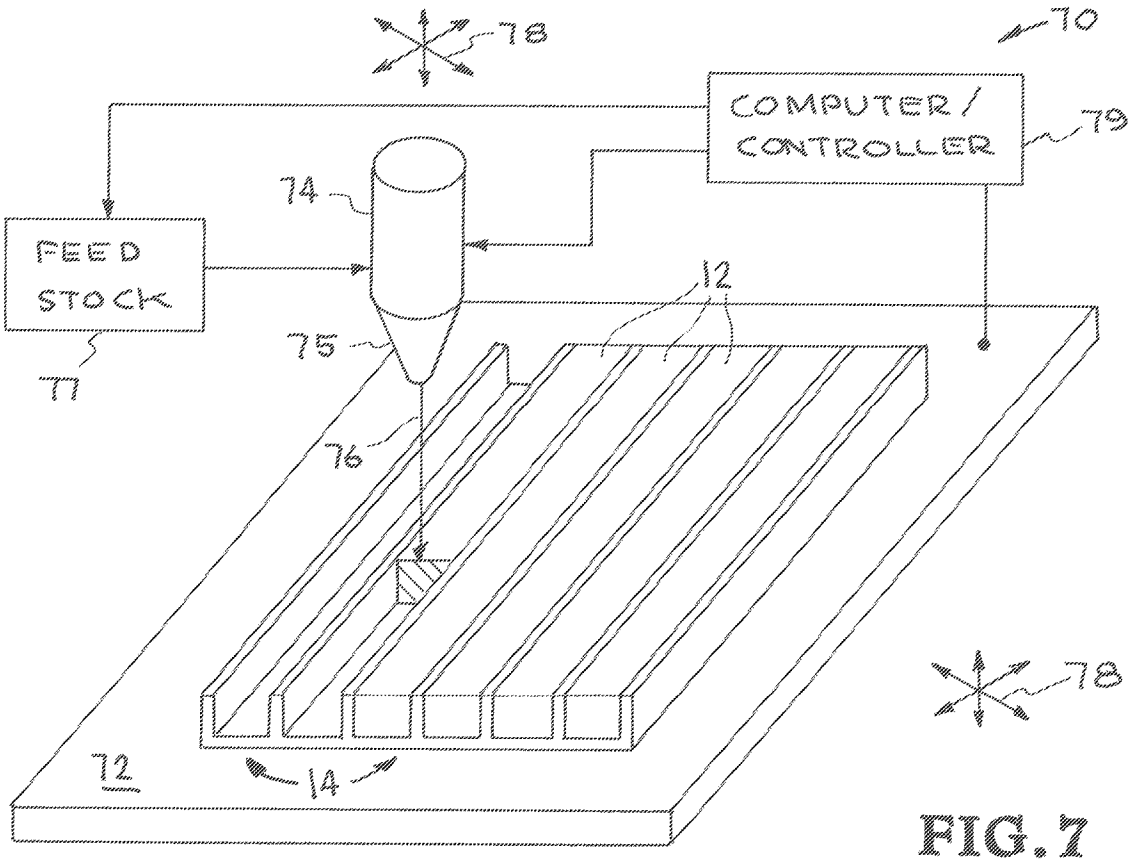
FIG. 7 shows an additive manufacturing system filling the scaffolds with a deposit of explosives to form the tracks of explosives.

Referring now to FIGS. 5, 6, and 7; the use of additive manufacturing to produce the shaped charge 10 is illustrated. The illustrations show different approaches to the use of additive manufacturing to produce the shaped charge 10.

FIG. 5 illustrates the scaffolds 14 used to deposit a surrounding explosive layer in which the direction of detonation propagation can be controlled. The scaffolds 14 provide the thinnest barrier between the tracks of explosives to prevent crosstalk and below the tracks of explosives to minimize imprinting of the material below the bottom of the tracks. The scaffolds 14 can be made of a polymer or other material that will prevent crosstalk. The scaffolds 14 need to be very thin to minimize the imprinting of the inert layer interrupting the uniform pressure loading on the liner, as required for a uniform collapse process. The scaffolds 14 are positioned in barber pole fashion around the cylindrical liner. The explosive can be added through a second process of extrusion, additive manufacturing or other process.

Referring now to FIG. 6 an additive manufacturing system used to produce the scaffolds 14 is illustrated. The additive manufacturing system is designated generally by the reference numeral 60. The additive manufacturing system 60 is a system for additively manufacturing (also known as 3D printing) that is used to make a three-dimensional object. Additive processes are used wherein successive layers of material are laid down under computer control. The three-dimensional objects can be of almost any shape or geometry and can be produced from a model or other electronic data source.

The scaffolds 14 are formed on a substrate 62 using a print head 64. Note that the front of the scaffolds 14 is at an angle that will facilitate wrapping the scaffolds 14 on the cylindrical liner. The print head 64 has a nozzle 65 for extruding the scaffold material 66 onto the substrate 62. The scaffold material 66 is contained in the feed stock container 67 and directed into the print head 64. The print head 64 extrudes the scaffold material 66 onto the substrate 62 to form the scaffolds 14. Movement of the print head 64 is controlled by computer/controller 69 which provides freedom of movement along all axes as indicated by the arrows 68. Specification details of the scaffolds 14 to be created by the system 60 are fed to the computer controller 69 to provide instructions for movement of the print head 64 and for extrusion of the scaffold material 66 onto the substrate 62 to form the scaffolds 14. For example, instructions for movement of the print head 64 and for extrusion of the scaffold material 66 can be provided by the widely used numerical control programming language G-Code.

Once the scaffolds 14 have been completed they are filled with explosive material to produce the tracks of explosives. The tracks of explosives in the scaffolds are positioned on the curved surface of the cylindrical liner in a spiral. The angle of the tracks of explosives (and the angel of the spiral) is an angle wherein initiation of the explosives produces a collapsing cylindrical liner having collapsing liner flow speed, wherein the collapsing cylindrical liner has a sound speed, and wherein the angle is an angle that assures that the flow speed of the collapsing liner is subsonic compared to the sound speed in the collapsing liner.

Referring now to FIG. 7 another embodiment of an additive manufacturing system used to produce the scaffolds 14 is illustrated. This embodiment of an additive manufacturing system is designated generally by the reference numeral 70. The additive manufacturing system 70 is a system for additively manufacturing (also known as 3D printing) that is used to make a three-dimensional object. Additive processes are used wherein successive layers of material are laid down under computer control. The three-dimensional objects can be of almost any shape or geometry and can be produced from a model or other electronic data source.

As explained with regard to FIG. 6, the scaffolds 14 are formed on a substrate. The scaffolds 14 are filled with an explosive material 76 using a print head 74. The print head 74 has a nozzle 75 for extruding the explosive material 76 into the scaffolds. The explosive material 76 is contained in the feed stock container 77 and directed into the print head 74. The print head 74 extrudes the explosive material 76 into the scaffolds 14 to form the tracks of explosives 12. Movement of the print head 74 is controlled by computer/controller 76 which provides freedom of movement along all axes as indicated by the arrows 78. Specification details are fed to the computer controller 76 to provide instructions for movement of the print head 74 and for extrusion of the explosive material 76 into the scaffolds 14. For example, instructions for movement of the print head 74 and for extrusion of the explosive material 76 can be provided by the widely used numerical control programming language G-Code.

Once the scaffolds 14 have been completed and filled with explosive material to produce the tracks of explosives, the tracks of explosives and the scaffolds are positioned on the curved surface of the cylindrical liner in a spiral. The angle of the tracks of explosives (and the angel of the spiral) is an angle wherein initiation of the explosives produces a collapsing cylindrical liner having collapsing liner flow speed, wherein the collapsing cylindrical liner has a sound speed, and wherein the angle is an angle that assures that the flow speed of the collapsing liner is subsonic compared to the sound speed in the collapsing liner.

Figure 8:
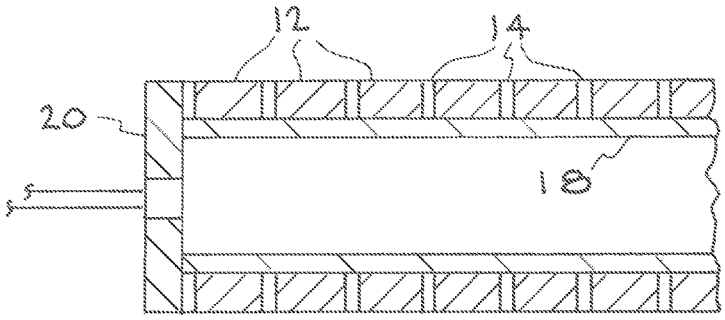
FIG. 8 is a cut away side view of an embodiment of the inventors' shaped charge.
Figure 9:
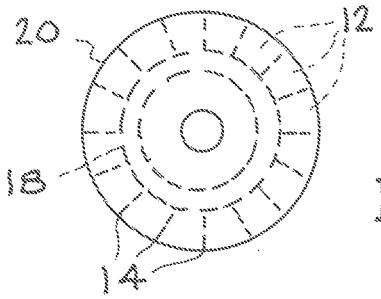
FIG. 9 is an end view of an embodiment of the inventors' shaped charge shown in FIG. 8.

Referring now FIGS. 8 and 9, illustrations provide additional information the inventors' shaped charge apparatus, systems, and methods 10. FIG. 8 is a cut away side view of the shaped charge 10. FIG. 9 is an end view of the shaped charge 10. The cylindrical liner 18 is shown with a detonator 20 positioned to detonate the tracks of explosives 12 in the scaffolds 14. The tracks of explosives 12 are positioned on the curved outer surface of the cylindrical liner 18 at an angle 20 forming a spiral or at least a portion of a spiral. The angle 20 of the spiral is such that the track 12 of explosives produces a detonation front that is constrained to propagate with respect to the charge axis. The shaped charge 10 design produces an explosive jet.

Figure 10:
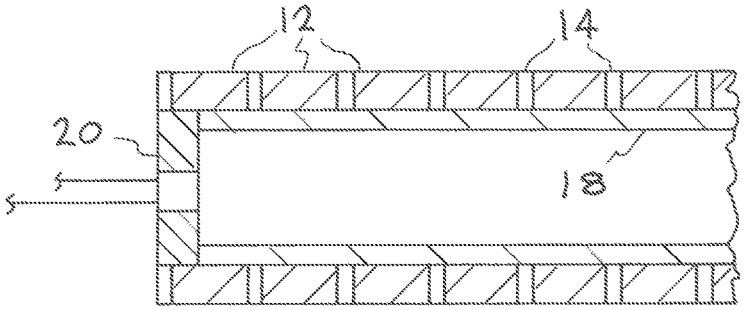
FIG. 10 is a cut away side view of another embodiment of the inventors' shaped charge.
Figure 11:
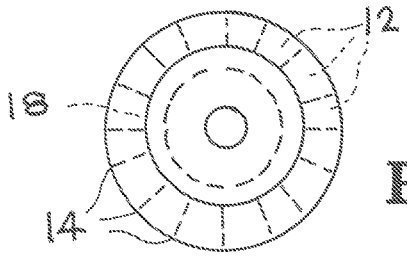
FIG. 11 is an end view of an embodiment of the inventors' shaped charge shown in FIG. 10.

Referring now FIGS. 10 and 11, illustrations show another embodiment of the inventors' shaped charge apparatus, systems, and methods 10. FIG. 10 is a cut away side view of the shaped charge 10. FIG. 11 is an end view of the shaped charge 10. The cylindrical liner 18 is shown with a detonator 20 positioned to detonate the tracks of explosives 12 in the scaffolds 14. The tracks of explosives 12 are positioned on the curved outer surface of the cylindrical liner 18 at an angle 20 forming a spiral or at least a portion of a spiral. The angle 20 of the spiral is such that the track 12 of explosives produces a detonation front that is constrained to propagate with respect to the charge axis. The shaped charge 10 design produces an explosive jet.

Figure 12:
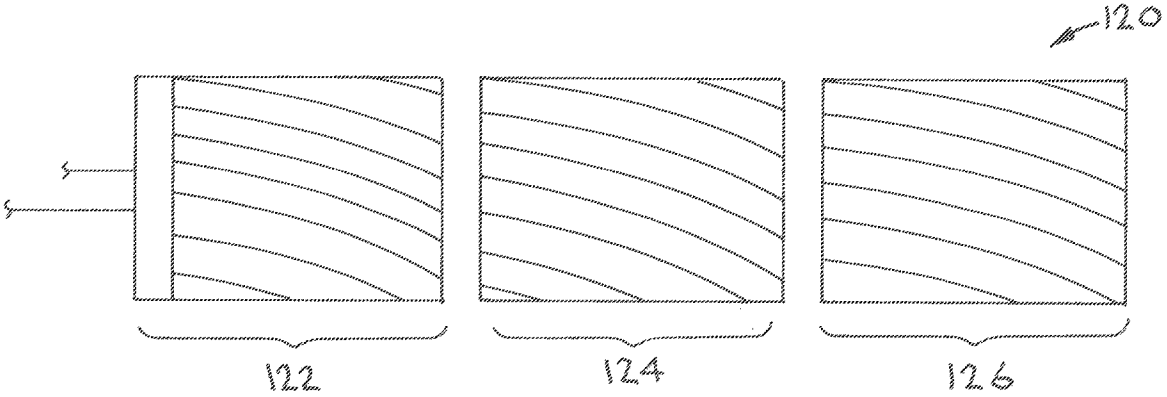
FIG. 12 is an illustration showing the coupling together of three modules producing a long jet.
Figure 13:
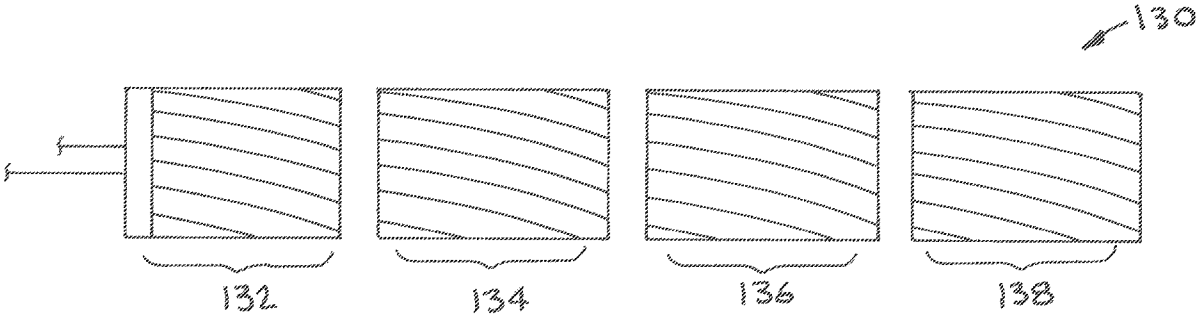
FIG. 13 is an illustration showing the coupling together of four modules producing a long jet.

Referring now FIGS. 12 and 13, illustrations show additional embodiments of the inventors' apparatus, systems, and methods. The cylindrical geometry allows for the coupling together of multiple modules thereby producing an arbitrarily long jet.

As illustrated in FIG. 12, one embodiment provides coupling together of three modules. This embodiment is designated generally by the reference numeral 120. The embodiment 120 provides a configuration of modules consisting of a base unit 122 which serves to initiate the detonation propagation and the formation of a jet. This base unit 122 can be comprised of a conventional explosive driving a shaped charge liner configuration previously described. The base unit 122 is directly coupled to a second cylindrical module 124 that is directly aligned with the base unit 122. The second cylindrical module 124 is directly coupled to a third cylindrical module 126 that is directly aligned with the second cylindrical module 124.

As illustrated in FIG. 13, another embodiment provides coupling together of four modules. This embodiment is designated generally by the reference numeral 130. The embodiment 130 provides a configuration of modules consisting of a base unit 132 which serves to initiate the detonation propagation and the formation of a jet. This base unit 132 can be comprised of a conventional explosive driving a shaped charge liner configuration previously described. The base unit 132 is directly coupled to a second cylindrical module 134 that is directly aligned with the base unit 132. The second cylindrical module 134 is directly coupled to a third cylindrical module 136 that is directly aligned with the second cylindrical module 134. The third cylindrical module 135 is directly coupled to a fourth cylindrical module 138 that is directly aligned with the third cylindrical module 136.

The modular aspect of this invention allows for in-field assembly of a modular components to adjust the length as well as the material(s) in a continuous jet. The modular aspect also allows for easy portability of individual modules which can be easily assembled to produce deep penetration.

Figure 14:
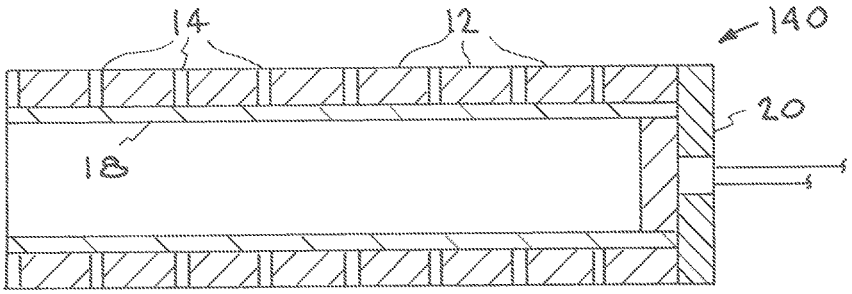
FIG. 14 illustrates the Applicants' invention as it might be used in the warhead of a torpedo.
Figure 15:
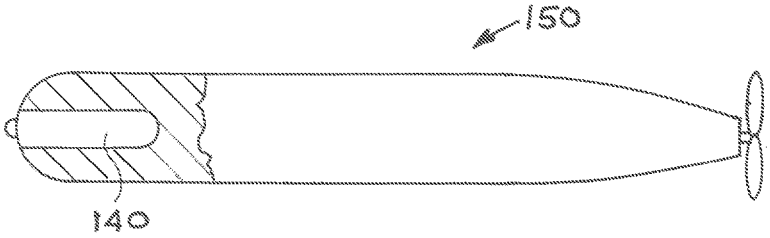
FIG. 15 illustrates the embodiment of FIG. 14 located in a warhead of a torpedo.

Referring now FIGS. 14 and 15, illustrations show additional embodiments of the inventors' apparatus, systems, and methods. As illustrated in FIG. 14, an embodiment of Applicants' invention provides a powerful explosive jet. This embodiment is designated generally by the reference numeral 140. The embodiment 140 provides a configuration of the Applicants' invention as it might be used in the warhead of a torpedo. The embodiment 140 includes the cylindrical liner 18 surrounded by tracks 12 of explosives in scaffolds 14. The tracks 12 of explosives in scaffolds 14 are wrapped around the cylindrical liner in a spiral. The detonator 20 produces detonation of the tracks 12 of explosives and the tracks of explosives propagate at an angle with respect to the charge axis.

Referring now to FIG. 15 the embodiment 140 of the inventors' apparatus, systems, and methods provides a warhead for use in a torpedo 150. The torpedo 150 contains the embodiment 140 that produces the powerful explosive jet.

Figure 16:
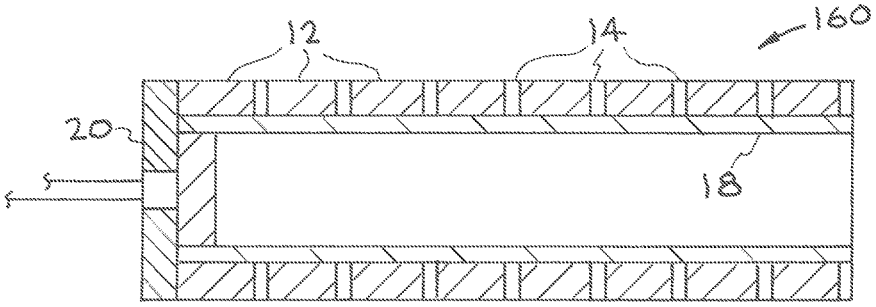
FIG. 16 illustrates the Applicants' invention as it might be used in an antitank shell.
Figure 17:
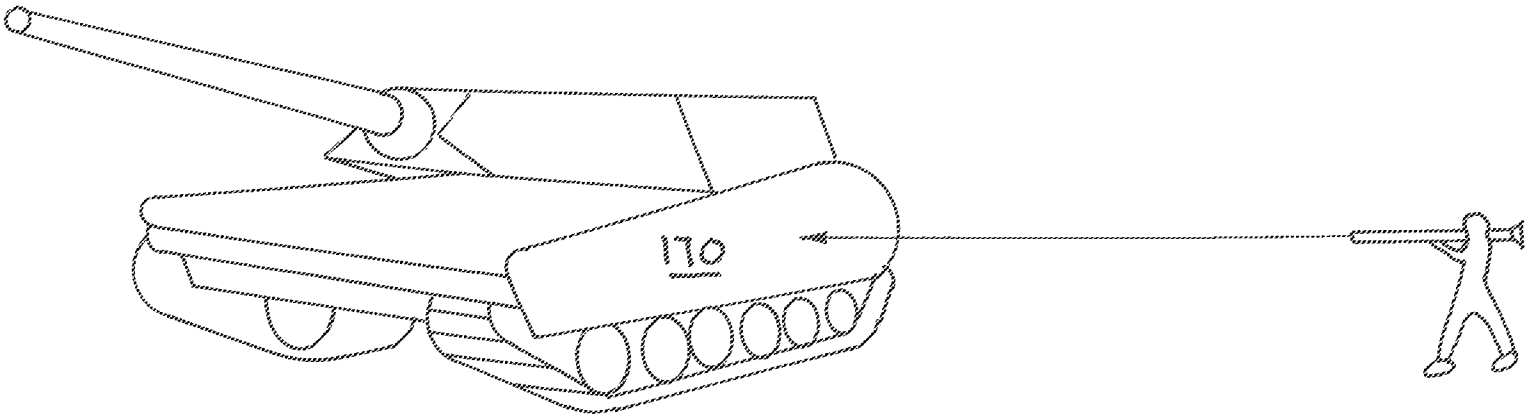
FIG. 17 illustrates the embodiment of FIG. 16 in an antitank shell that is directed onto the armor of tank.

Referring now FIGS. 16 and 17, illustrations show additional embodiments of the inventors' apparatus, systems, and methods. As illustrated in FIG. 16, an embodiment of the Applicants' invention is shown as it might be used in an antitank shell. This embodiment is designated generally by the reference numeral 160. The embodiment 160 includes the cylindrical liner 18 surrounded by tracks 12 of explosives in scaffolds 14. The tracks 12 of explosives in scaffolds 14 are wrapped around the cylindrical liner in a spiral. The detonator 20 produces detonation of the tracks 12 of explosives and the tracks of explosives propagate at an angle with respect to the charge axis.

Referring now to FIG. 17, an embodiment of Applicant's apparatus, systems, and methods provides a shell containing the shaped charge 160 that is directed onto the armor of tank 170. The shaped charge 160 produces a jet for punching a hole in the armor of tank 170.

Figure 18:
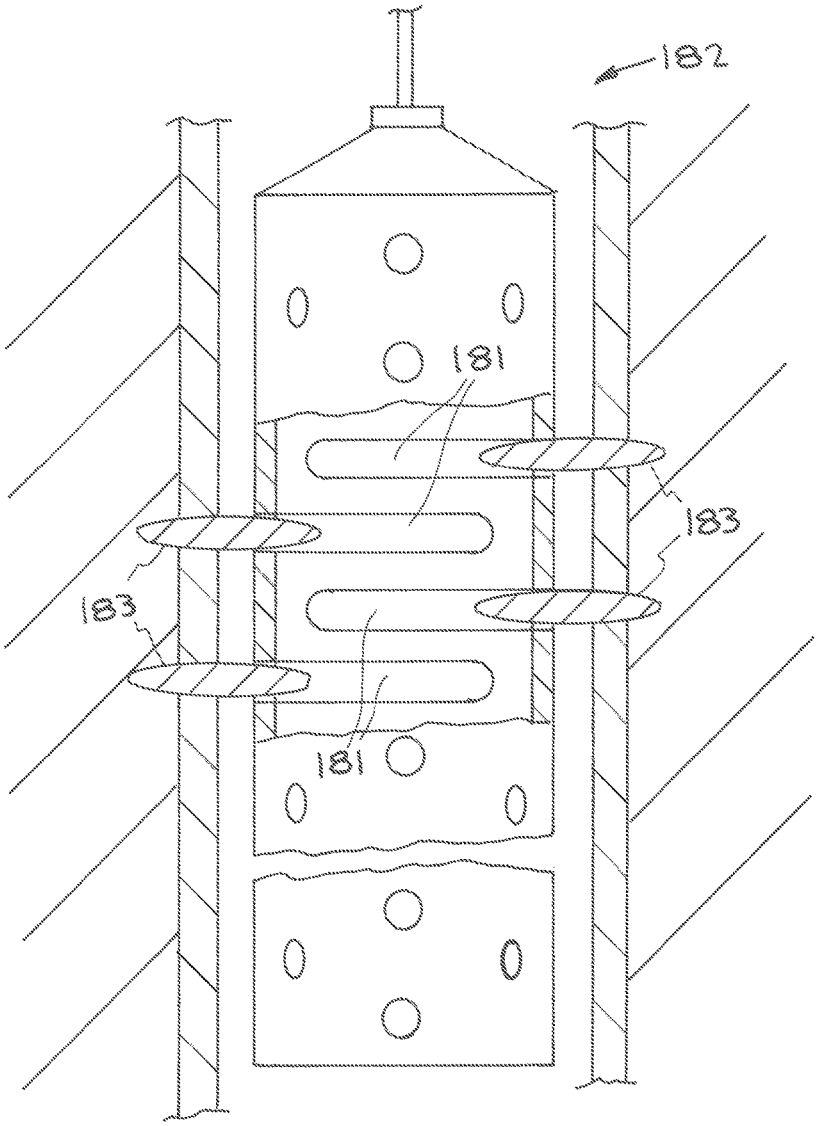
FIG. 18 illustrates another embodiment of Applicants' invention used in a perforator charge for perforating a well.

Referring now to FIG. 18, another embodiment of Applicant's apparatus, systems, and methods is illustrated. The embodiment is designated generally by the reference numeral 180. The embodiment 180 provides a perforator 181 for use in perforation of well 182. The well 182 can be an oil well, a gas well, a geothermal well, a water well, an injection well, a withdrawal well or other type of well. The perforator 181 is a shaped charge that produces a jet 183 for punching a hole 184 in the casing or liner of the well 182. The perforator 182 produces the jet 183.

The perforator 181 comprises a configuration of modules consisting of a base unit which serves to initiate the detonation propagation and the formation of a jet. This base unit can be comprised of a conventional explosive driving a shaped charge liner configuration previously described. The base unit is directly coupled to multiple additional modular units that are all in alignment with the base unit.

Figure 19:
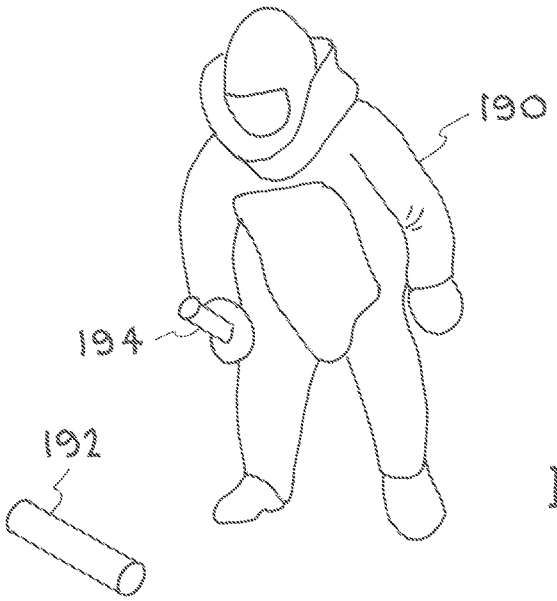
FIG. 19 is an illustration of an individual in a bomb protective suit holding a hand portable device that uses the inventors' shaped charge to produce an explosive jet and dispose of a pipe bomb.
Figure 20:
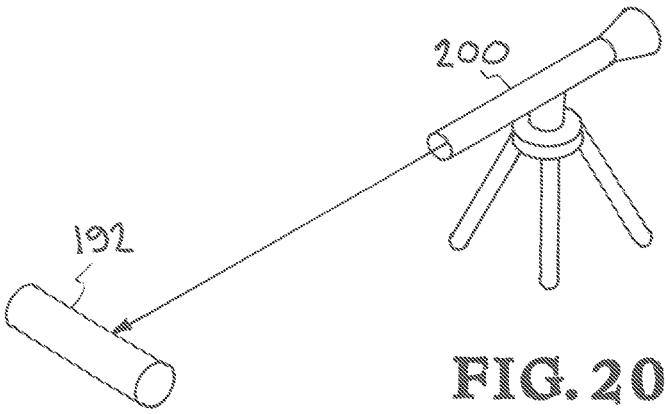
FIG. 20 is an illustration of a device such as a hand portable launcher that uses the inventors' shaped charge to produce an explosive jet and dispose of a pipe bomb.

Referring now FIGS. 19 and 20, illustrations show the detection, identification, on-site evaluation, rendering safe, recovery, and final disposal of unexploded explosive ordnance using embodiments of the inventors' apparatus, systems, and methods. FIG. 19 is an illustration of an individual 190 in a bomb suit (also known as an Explosive Ordnance Disposal (EOD) suit or a blast suit) who has discovered an unexploded bomb or ordinance in the form of a pipe bomb 192. The individual 190 in a bomb suit is holding a handheld device 194 that uses the inventors' shaped charge to produce an explosive jet to dispose of the pipe bomb 192.

In addition to uses of the inventors' shaped charge to produce an explosive jet to dispose of the pipe bomb 192, there are other uses for detection, identification, on-site evaluation, rendering safe, recovery, and final disposal of unexploded explosive ordnance. Unexploded ordnance from at least as far back as the American Civil War still poses a hazard worldwide, both in current and former combat areas and on military firing ranges. A major problem with unexploded ordnance is that over the years the detonator and main charge deteriorate, frequently making them more sensitive to disturbance, and therefore more dangerous to handle. Construction work may disturb unsuspected unexploded bombs, which may then explode. There are countless examples of people tampering with unexploded ordnance that is many years old, often with fatal results. Believing it to be harmless they handle the device and it explodes, causing deaths, injuries, and damage. For this reason, it is universally recommended that unexploded ordnance should not be touched or handled by unqualified persons. Instead, the location should be reported to the local police so that bomb disposal or Explosive Ordnance Disposal (EOD) professionals can render it safe.

FIG. 20 shows the final disposal of the unexploded pipe bomb 192 using another embodiment of the inventors' apparatus, systems, and methods. A hand portable launcher 200 uses a shell containing the inventors' shaped charge that is directed onto the unexploded bomb or explosive ordnance 192. The shaped charge produces a jet for destroying the unexploded bomb or explosive ordnance 192. Alternately, the hand portable launcher 200 can direct an explosive jet onto the unexploded bomb or explosive ordnance 192 for the final disposal.

Figure 21:
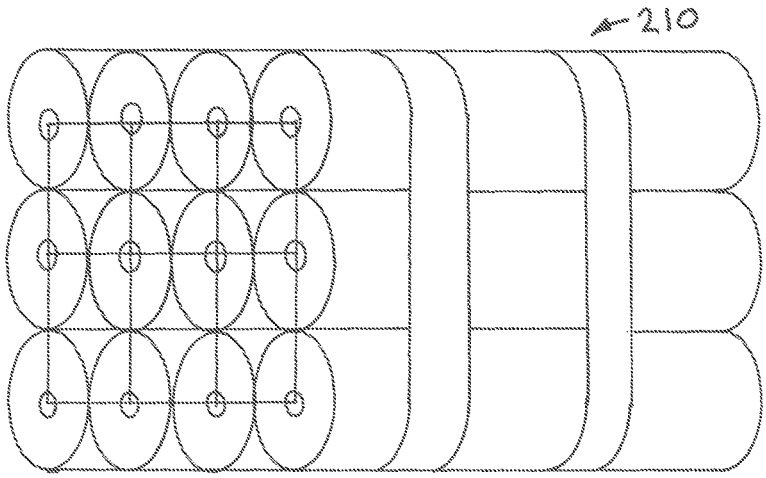
FIG. 21 is an illustration of an improvised explosive device (IED) such as a road side bomb.
Figure 22:
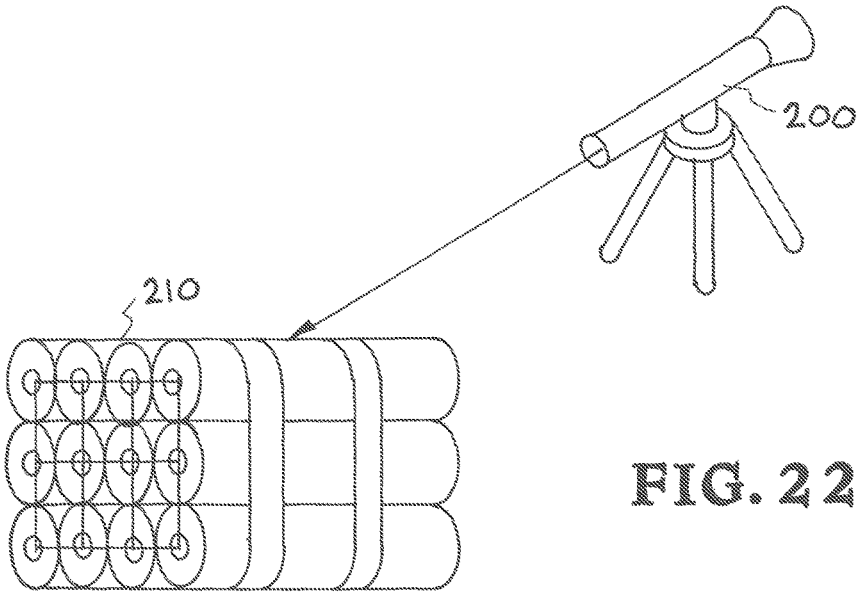
FIG. 22 shows the final disposal of a roadside bomb using embodiments of the inventors' apparatus, systems, and methods.

Referring now FIGS. 21 and 22, illustrations show the detection, identification, on-site evaluation, rendering safe, recovery, and final disposal of a roadside bomb 210. FIG. 21 is an illustration of an improvised explosive device (IED) that is a bomb constructed and deployed in ways other than in conventional military action. It may be constructed of conventional military explosives, such as an artillery round, attached to a detonating mechanism. IEDs are commonly used as roadside bombs.

FIG. 22 shows the final disposal of the roadside bomb 210 using embodiments of the inventors' apparatus, systems, and methods. A hand portable launcher 220 uses a shell containing the inventors' shaped charge that is directed onto the roadside bomb 210. The shell includes a shaped charge that produces a jet for destroying the roadside bomb 210. Alternately, the hand portable launcher 220 can direct an explosive jet onto the roadside bomb 210 for disposal of the roadside bomb 210.

Although the description above contains many details and specifics, these should not be construed as limiting the scope of the application but as merely providing illustrations of some of the presently preferred embodiments of the apparatus, systems, and methods. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present application fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present apparatus, systems, and methods, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

While the apparatus, systems, and methods may be susceptible to various modifications and alternative forms, specific embodiments have been shown by way of example in the drawings and have been described in detail herein. However, it should be understood that the application is not intended to be limited to the particular forms disclosed. Rather, the application is to cover all modifications, equivalents, and alternatives falling within the spirit and scope of the application as defined by the following appended claims.

The invention claimed is:

1. A shaped charge apparatus that produces a jet, comprising:

a cylindrical liner, wherein said cylindrical liner is made of a material and wherein said cylindrical liner has a charge axis;

explosives wrapped around said cylindrical liner forming a spiral or at least a portion of a spiral, wherein said explosives wrapped around said cylindrical liner are wrapped at an angle to said charge axis; and a detonator operatively positioned relative to said explosives that initiates said explosives and produces the jet, wherein said initiation of said explosives produces a collapsing cylindrical liner having a collapsing liner flow speed, wherein said collapsing cylindrical liner has a sound speed in the material of said cylinder liner, and wherein said angle is an angle that assures that said flow speed of said collapsing liner is subsonic compared to said sound speed in the material of said collapsing liner.

2. The shaped charge apparatus of claim 1 wherein said angle is in the range of 40° to 70°.

3. The shaped charge apparatus of claim 2 wherein said angle is an angle of 51°.

4. A shaped charge apparatus that produces a jet, comprising:

a cylindrical liner, wherein said cylindrical liner is made of a material and wherein said cylindrical liner has a charge axis;

explosives wrapped around said cylindrical liner forming a spiral or at least a portion of a spiral, wherein said explosives are tracks of explosive material, and wherein said tracks of explosives material are wrapped around said cylindrical liner at an angle to said charge axis; and a detonator operatively positioned relative to said explosives that initiates said explosives and produces the jet, wherein said tracks of explosives produce a collapsing cylindrical liner having a collapsing liner flow speed, wherein said collapsing cylindrical liner has a sound speed in the material of said cylinder liner, and wherein said angle is an angle that assures that said flow speed of said collapsing liner is subsonic compared to said sound speed in the material of said collapsing liner.

5. A shaped charge apparatus that produces a jet, comprising:

a cylindrical liner, wherein said cylindrical liner is made of a material and wherein said cylindrical liner has a charge axis;

explosives wrapped around said cylindrical liner forming a spiral or at least a portion of a spiral, wherein said explosives are tracks of explosive material in scaffolds, wherein said scaffolds are located to provide barriers between said tracks of explosive material, wherein said scaffolds provide barriers between said tracks of explosive material that prevent crosstalk between said tracks of explosive material, and wherein said scaffolds are made of a polymer; and a detonator operatively positioned relative to said explosives that initiates said explosives and produces the jet, wherein said initiation of said explosives produces a collapsing cylindrical liner having a collapsing liner flow speed, wherein said collapsing cylindrical liner has a sound speed in the material of said cylinder liner, and wherein said angle is an angle that assures that said flow speed of said collapsing liner is subsonic compared to said sound speed in the material of said collapsing liner.

6. A method of making a shaped charge that produces a jet, comprising the steps of:

providing a cylindrical liner, wherein said cylindrical liner is made of a material, wherein said cylindrical liner has a charge axis and wherein said explosives are located around said cylindrical liner at an angle to said charge axis;

locating explosives around said cylindrical liner in a spiral or at least a portion of a spiral; and providing a detonator operatively positioned relative to said explosives that initiates said explosives and produces the jet wherein said initiation of said explosives produces a collapsing cylindrical liner having a collapsing liner flow speed, wherein said collapsing cylindrical liner has a sound speed in the material of said cylinder liner, and wherein said angle is an angle that assures that said flow speed of said collapsing liner is subsonic compared to said sound speed in the material of said collapsing liner.

7. The method of making a shaped charge that produces a jet of claim 6 wherein said angle is in the range of 47° to 55°.

8. The method of making a shaped charge that produces a jet of claim 6 wherein said angle is an angle of 51°.

* * * * *